US007287358B2

(12) United States Patent
Zambelli et al.

(10) Patent No.: US 7,287,358 B2
(45) Date of Patent: Oct. 30, 2007

(54) DEVICE FOR CONNECTING A BEAM TO PILLARS OR SIMILAR SUPPORTING STRUCTURAL ELEMENTS FOR ERECTING BUILDINGS

(76) Inventors: Sergio Zambelli, Via Stezzano, 28, 24050 Zanica (IT); Benito Zambelli, Via Roma, 44, 24050 Zanica (IT)

( * ) Notice: Subject to any disclaimer, the term of this patent is extended or adjusted under 35 U.S.C. 154(b) by 0 days.

(21) Appl. No.: 10/674,554

(22) Filed: Oct. 1, 2003

(65) Prior Publication Data

US 2004/0065030 A1 Apr. 8, 2004

(30) Foreign Application Priority Data

Oct. 4, 2002 (IT) ..... MI2002A2119

(51) Int. Cl.
*E04H 12/00* (2006.01)

(52) U.S. Cl. ..... 52/649.2; 52/231; 52/283; 52/272; 52/236.6; 52/223.13

(58) Field of Classification Search ..... 52/231, 52/649.2, 236.6, 236.9, 283, 272, 274, 223.13, 52/223.8; 138/157, 121
See application file for complete search history.

(56) References Cited

U.S. PATENT DOCUMENTS 2,303,394 A * 12/1942 Schorer ..... 52/223.13
3,015,912 A * 1/1962 Fistedis ..... 52/741.15
3,498,013 A * 3/1970 Kern ..... 52/223.13
3,744,200 A 7/1973 Rice
3,788,023 A * 1/1974 Macchi ..... 52/745.19
3,863,891 A * 2/1975 Leonte ..... 254/29 A
3,922,823 A * 12/1975 King et al. ..... 52/169.3
3,952,468 A 4/1976 Soum
4,023,315 A * 5/1977 Stucky ..... 52/79.13
4,644,978 A * 2/1987 Bonasso ..... 138/157
5,272,851 A * 12/1993 De La Fuente ..... 52/600
6,327,825 B1 * 12/2001 Sanders et al. ..... 52/167.1
6,659,135 B2 * 12/2003 Sorkin ..... 138/121

FOREIGN PATENT DOCUMENTS

EP 1 092 814 4/2001

* cited by examiner

*Primary Examiner*—Basil Katcheves
(74) *Attorney, Agent, or Firm*—Modiano & Associati; Albert Josif; Daniel J. O'Byrne

(57) ABSTRACT

A device for connecting a beam to pillars or similar supporting structural elements in order to erect buildings, particularly multistory buildings, by means of prefabricated concrete components, the device comprising first means for connecting two end regions of the beam to the pillars and second means for connecting the beam to the pillars, the first connection means provide a coupling at least of the hinge type between each one of the two end regions of the beam and the corresponding pillar; the second connection means comprise at least one tension element that passes through the beam and is connected to the pillars by means of the ends thereof that protrude from the beam.

30 Claims, 5 Drawing Sheets

DEVICE FOR CONNECTING A BEAM TO PILLARS OR SIMILAR SUPPORTING STRUCTURAL ELEMENTS FOR ERECTING BUILDINGS

BACKGROUND OF THE INVENTION

The present invention relates to a device for connecting a beam to pillars or similar supporting structural elements for erecting buildings, particularly multistory buildings, by means of prefabricated concrete components.

As is known, the building method that uses prefabricated concrete components has, in recent years, become increasingly widespread mainly thanks to its reduced execution times compared to the traditional method of on-site building.

However, in some particular sectors, the prefabrication technique has not yet been able to expand fully.

One of these sectors is constituted by the erection of buildings used for office or residential purposes, particularly if they are of the multistory type.

Prefabricated concrete components are in fact currently scarcely applied in this field, because prefabricated beams, in order to withstand the loads to which they are subjected by using a coupling to the pillar that consists of simple resting thereon at their ends, have an excessive vertical space occupation.

On-site building operations are able to minimize the height of the beams thanks to the fact that with this construction method there is an uninterrupted continuity between the pillar and the beam.

Prefabrication instead entails, for the various parts that compose the building, a momentary discontinuity, which is eliminated only with final assembly. However, this fact entails that prefabricated beams, as mentioned, must be inevitably higher than beams built on-site.

The prefabrication method has tried to obviate these drawbacks by resorting to pre-stressing, which consists in loading the beam by compressing it beforehand so as to bend it upward. However, this solution is advantageous with considerable spans, i.e., distances between the pillars, otherwise the resulting saving in beam height and therefore the financial saving are insignificant.

However, it should be noted that the prefabrication method allows an unequalled erection speed as well as industrial-type production and quality control; moreover, the prefabrication method allows to build regardless of weather conditions, which instead can have a severe effect on on-site building, and makes the progress of work independent of the waiting time for the concrete to cure, which greatly slows down the erection of multistory buildings with the traditional method of on-site building.

In view of the undeniable advantages offered by the prefabrication method, the need is felt to be able to extend its application also to those fields which, for the reasons described above, have not yet been able to adopt this method.

U.S. Ser. No. 09/669,970 by the same Applicants discloses a device for connecting a beam to pillars or similar supporting structural elements for erecting buildings, particularly multistory buildings, by means of prefabricated concrete components that allows to reduce the height of the beam, despite the beam being prefabricated, without necessarily having to resort to prestressing of the beam.

Such device substantially comprises first means for connecting the two end regions of the beam to the pillars and second means for connecting two intermediate regions of the longitudinal extension of the beam to the pillars. The first connection means are constituted by connection means of the interlocking type, while the second connection means comprise at least two inclined rigid tension elements, each element connecting an intermediate region of the longitudinal extension of the beam and a region of the respective pillar that is located at a higher vertical level than the region where the tension element is coupled to the beam.

During its testing and use, the device has proved to be susceptible of improvements aimed mainly at achieving a more uniform distribution of the stresses within the beam and at introducing a new static layout.

SUMMARY OF THE INVENTION

The aim of the present invention is to provide a device for connecting a beam to pillars or similar supporting structural elements for erecting buildings, particularly multistory buildings, by means of prefabricated concrete components, that allows to reduce the height of the beam although said beam is prefabricated, without necessarily having to resort to pre-stressing of the beam, and also achieves the most uniform possible distribution of the stresses to which the beam is subjected.

Within this aim, an object of the invention is to provide a device that does not generate additional space occupation for the beam and for the pillars.

Another object of the invention is to provide a device that allows to use advantageously the prefabrication method in buildings, including multistory buildings, with beams that are significantly shorter than the beams normally used in industrial buildings.

A further object of the invention is to provide a device that provides a beam-pillar connection that has excellent earthquake resistance.

This aim and these and other objects that will become better apparent hereinafter are achieved by a device for connecting a beam to pillars or similar supporting structural elements in order to erect buildings, particularly multistory buildings, by means of prefabricated concrete components, characterized in that it comprises first means for connecting two end regions of the beam to the pillars and second means for connecting the beam to the pillars, said first connection means being adapted to provide a coupling at least of the hinge type between each one of the two end regions of the beam and the corresponding pillar, said second connection means comprising at least one tension element that passes through the beam and is connected to the pillars by means of ends thereof that protrude from the beam.

BRIEF DESCRIPTION OF THE DRAWINGS

Further characteristics and advantages of the invention will become better apparent from the description of a preferred but not exclusive embodiment of the device according to the invention, illustrated by way of nonlimitative example in the accompanying drawings, wherein.

DESCRIPTION OF THE PREFERRED EMBODIMENTS

Figure 1:
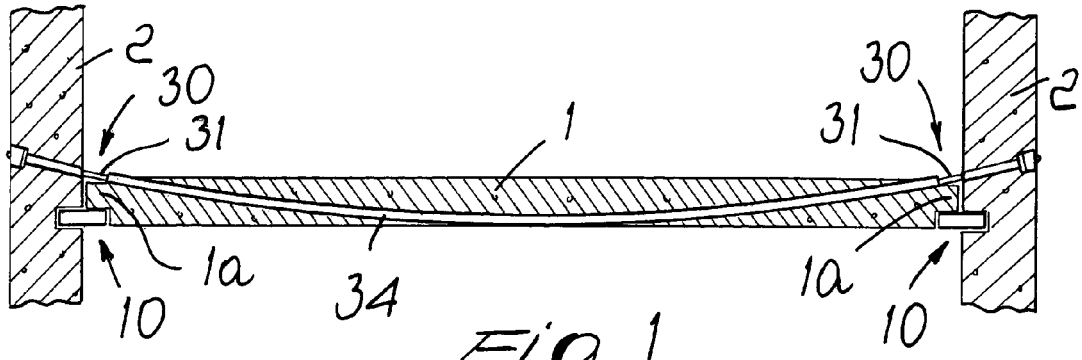
FIG. 1 is a schematic sectional view, taken along a vertical plane, of the connection of a beam to two pillars with the device according to the invention, in a first embodiment.

With reference to the figures, the device according to the invention, in its various embodiments, comprises first means 10 for connecting the two end regions 1*a* of a beam 1 to the pillars 2 that must support the beam 1, and second means 30 for connecting the beam 1 to the pillars 2.

The first connection means 10 are constituted by connection means that ensure a coupling at least of the hinge type between each one of the two longitudinal ends of the beam 1 and the corresponding pillar 2, and the second connection means 30 comprise at least one tension element 31 that passes through the beam 1 and is connected to the pillars 2 by means of its ends that protrude from the beam 1.

The device according to the invention further comprises means for tensioning to the desired extent the tension element or elements 31 so as to preload the beam 1, as will become better apparent hereinafter.

Conveniently, the regions for the passage of the tension elements 31 in the beam 1 and the regions for the coupling of the tension elements 31 to the pillars 2 are arranged so that the portion of the tension elements 31 that lies between the beam 1 and the pillars 2 can be easily embedded within the thickness of the slab 3 or other concrete component cast on the beam 1 or otherwise embedded in the floor 4, so that the tension elements 31 are perfectly concealed at the end of the construction work.

For the sake of simplicity in description, the first connection means 10 and the second connection means 30 are described with reference to the connection of a longitudinal end of the beam 1 to a pillar 2, without altering the fact that the other longitudinal end of the beam 1 is connected to the other pillar 2 that supports it by similar connection means.

The first connection means 10 comprise at least one cavity 11 that is formed in a body of the pillar 2 and is open on the side of the pillar 2 that is directed toward the beam 1. Preferably, two cavities 11 are provided in the body of the pillar 2 for each one of the longitudinal ends of the beam 1 to be supported; said cavities are spaced horizontally one with respect to another, i.e., transversely to the longitudinal extension of the beam 1 to be supported. Each one of the cavities 11 accommodates a bracket 12, which protrudes from the side of the pillar 2 that is directed toward the beam 1 and is fixed to the end region 1*a* of the beam 1.

Each cavity 11 is formed by a box-like body 13, which is embedded in the concrete casting that constitutes the pillar 2 during its production.

The box-like body 13 can be constituted for example by a tubular steel body that is open at one of its ends, which is arranged flush with the side of the pillar 2 that is designed to be directed toward the beam 1. If, as preferred, there are two cavities 11 for each one of the longitudinal ends of the beam 1 to be supported, the two tubular bodies that form the cavities 11 can be fixed beforehand, for example by welding, to a steel L-shaped element 14, which is also embedded in the body of the pillar 2.

Each bracket 12 also can be constituted by a steel component that is inserted in the corresponding cavity 11 so as to protrude with one of its ends from the side of the pillar 2 that is directed toward the beam 1. Such end of the bracket 12 forms a support for the end region 1*a* of the beam 1, and is rigidly fixed to the beam 1 in order to provide a connection at least of the hinge type, and preferably of the interlocking type, between the beam 1 and the pillar 2.

Each bracket 12 can be constituted by a steel insert with a transverse cross-section that is complementary to the cross-section of the corresponding cavity 11 and is preferably rectangular or square, tubular or solid.

If, as preferred, there are two brackets 12 for each one of the longitudinal ends of the beam 1, said two brackets can be optionally fixed, for example by welding, to a connecting plate 12*a*.

Optionally, the cavities 11 and the brackets 12 can be inclined upward toward the beam 1 in order to achieve higher stability in the resting of the beam 1 on the brackets 12. In practice, the brackets 12 form two supporting regions for each longitudinal end of the beam 1, and the supporting regions are spaced horizontally one another, transversely to the longitudinal extension of the beam 1, so as to achieve greater resistance of the beam to torque stresses about its longitudinal axis.

The bracket or brackets 12 are fixed to the beam 1 preferably by bolting.

More particularly, the end 1*a* of the beam 1 is preferably provided by means of a contoured box-like structure 15, made for example of steel, which is monolithically anchored in the concrete casting that constitutes the beam 1 and forms, on the lower side of the end 1*a* of the beam 1, a recess 16 for each one of the brackets 12.

In the box-like structure 15, at each one of the recesses 16, there is at least one hole 17, preferably of the slotted type, which is designed to be aligned with a corresponding hole 18 provided in the corresponding bracket 12 and to be used in order to bolt the corresponding end 1*a* of the beam 1 to the bracket or brackets 12 by means of bolts 20.

The second connection means 30, depending on the width of the beam 1 and on the stresses that such beam must withstand, may be constituted by one or more tension elements 31.

Each tension element 31 protrudes, with its longitudinal end, from the beam 1 proximate to the longitudinal ends 1*a* thereof.

Each tension element 31 passes with play through a passage 32 that is formed in the body of the beam 2 and is curved or shaped like a broken line in which the cavity is directed upward. The extrados of the passage 32, starting from the longitudinal ends of the beam 1 and advancing toward the intermediate region of the longitudinal extension of the beam 1, gradually moves closer to the lower side of said beam 1.

The passage 32 can be formed by at least one tubular body 34, which is embedded in the body of the beam 1 and has inlets at the upper side of the beam 1 proximate to the longitudinal ends 1*a* of said beam.

The tubular body 34 can be constituted by a tubular body made of steel which is substantially rigid, or by a flexible tubular body that is knurled on its outer surface so as to firmly anchor to the concrete casting that constitutes the body of the beam 1 and transmit thereto the stresses to which it is subjected.

It should be noted that the tubular body 34 that forms the passage 32 increases the frame 51 of the beam 1 and can be optionally connected to said frame 51.

It is optionally possible to arrange multiple tension elements 31 inside a same passage 32.

Figure 2:
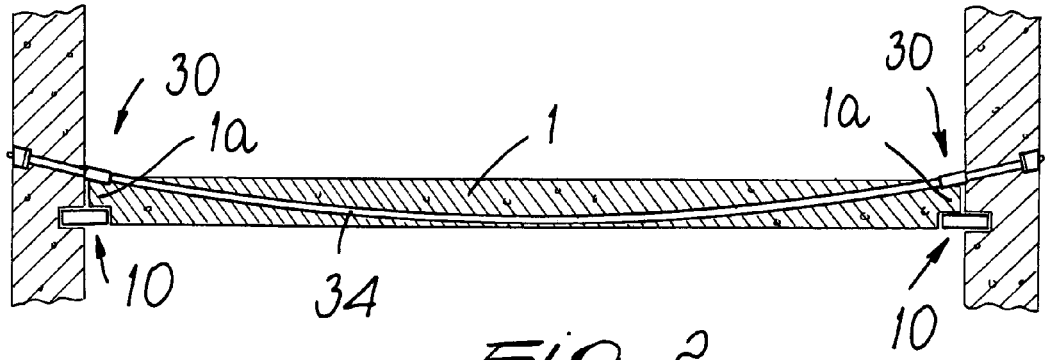
FIG. 2 is a schematic sectional view, taken along a vertical plane, of the connection of a beam to two pillars with the device according to the invention, in a second embodiment.
Figure 3:
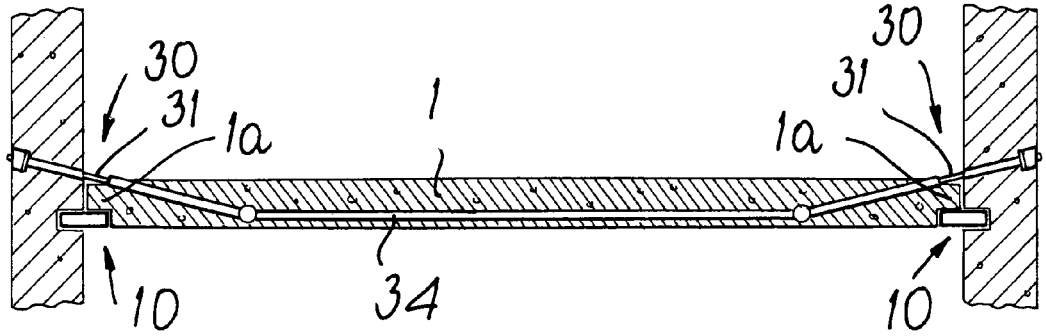
FIG. 3 is a schematic sectional view, taken along a vertical plane, of the connection of a beam to two pillars with the device according to the invention, in a third embodiment.

The tubular body 34 can be formed monolithically or can be constituted by multiple tubular segments that are connected one another by welding or by other known kinds of connection means, as shown in particular in FIGS. 2 and 3.

The tension element 31 can be constituted by a steel bar or by a cable element.

The tension element 31 also can be formed monolithically or can be composed of multiple segments that are connected one another, for example by welding or by other known kinds of connection means.

If the tension element 31 is provided by connecting multiple segments, said segments may be partly rigid and partly flexible.

Optionally, the tubular body 34 can also be fixed, for example by welding, to the box-like structure 15.

The tension element 31 is connected, by its ends that protrude from the beam 1, to the pillars 2 above the connection regions formed by the first connection means 10, i.e., above the regions where the beam 1 rests on the brackets 12.

Figure 4:
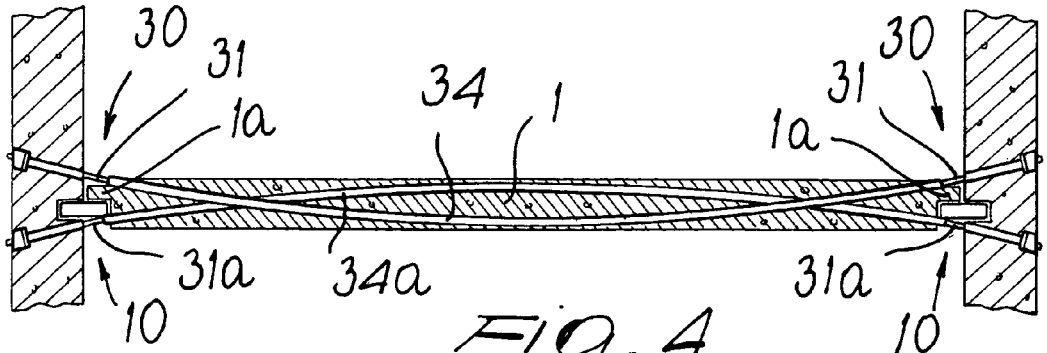
FIG. 4 is a schematic sectional view, taken along a vertical plane, of the connection of a beam to two pillars with the device according to the invention, in a fourth embodiment.

If the building to be erected is required to have a particular earthquake resistance, it is also possible to provide at least one auxiliary tension element 31*a* that passes with play through at least one auxiliary passage formed within the beam and is curved or shaped like a broken line in which the cavity is directed downward, as shown in FIG. 4. The extrados of the auxiliary passage, starting from the longitudinal ends 1*a* of the beam 1 and advancing toward the intermediate region of the longitudinal extension of the beam 1, moves gradually closer to the upper side of the beam 1.

The auxiliary tension element 31*a* is connected, by means of its ends that protrude from the beam 1 proximate to the longitudinal ends 1*a* thereof, to the pillars 2 below the connection regions formed by the first connection means 10, i.e., below the regions where the beam 1 rests on the brackets 12.

The passage for the auxiliary tension element 31*a* also can be formed by a tubular body 34*a* that is embedded in the body of the beam 1.

The number of auxiliary tension elements 31*a* can vary according to the strength that the beam 1 is required to have.

The auxiliary tension elements 31*a*, like the tubular bodies 34*a* that form the auxiliary passages, can be provided substantially as already described with reference to the tension elements 31 and to the tubular bodies 34 except for the arrangement, which for the auxiliary tension elements 31*a* and the corresponding tubular bodies 34*a* provides for a downward-facing concavity.

The tension elements 31 are connected to the pillars 2 so as to allow tensioning of the tension elements 31.

More particularly, in each pillar 2, in a region located above the supporting surface formed by the brackets 12, there is a passage 33 for each tension element 31, so as to arrange the coupling region of the tension element 31 proximate to the side of the pillar 2 that lies opposite the side directed toward the beam 1.

The passage 33 is formed by an additional tubular body 46, preferably made of steel, which is embedded within the pillar 2 during its manufacture.

The tubular body 46 has an end that is flush with the side of the pillar 2 that is directed toward the beam 1 and another end that is flush with the side of the pillar 2 that lies opposite with respect to the beam 1. The tubular body 46 has, proximate to this end, a larger diameter so as to form an abutment for a nut 47 that is screwed onto the appropriately threaded end portion of the tension element 31 in order to fix the tension element 31 to the pillar 2 and allow the tensioning of the tension element 31. As an alternative, instead of threading the end of the tension element 31, it possible to use a particular ribbing of the tension element 31 as a thread for the nut 47.

An end plate 48 can be welded where the diameter of the tubular body 46 changes, inside said tubular body 46, and is crossed by a hole 49 in order to allow the passage of the tension element 31.

Optionally, the tubular body 46 can be rigidly connected to the box-like body or bodies 13, for example by means of a bar to which it is welded.

The tubular body 46 and the box-like bodies 13 thus constitute a monolithic structure to be embedded in the pillar 2, achieving good precision in the arrangement of the tubular body 46 with respect to the cavity 11 for the bracket 12, thus facilitating the mutual assembly of the beam 1 and the pillar 2 and the insertion of the tension element 31 in the pillar 2 and in the beam 1.

If the pillar 2 is required to support beams 1 on its two opposite sides or in any case on two or more sides, multiple tubular bodies 46 are embedded in the body of the pillar 2 and are variously orientated in order to receive the various tension elements 31 that pass through the various beams 1 supported by the pillar 2, and various box-like bodies 13 for brackets 12, according to the requirements, are also embedded.

The connection of the auxiliary tension elements 31*a* to the pillars 2 can be provided in a manner similar to the one described with reference to the tension elements 31.

Figure 7:
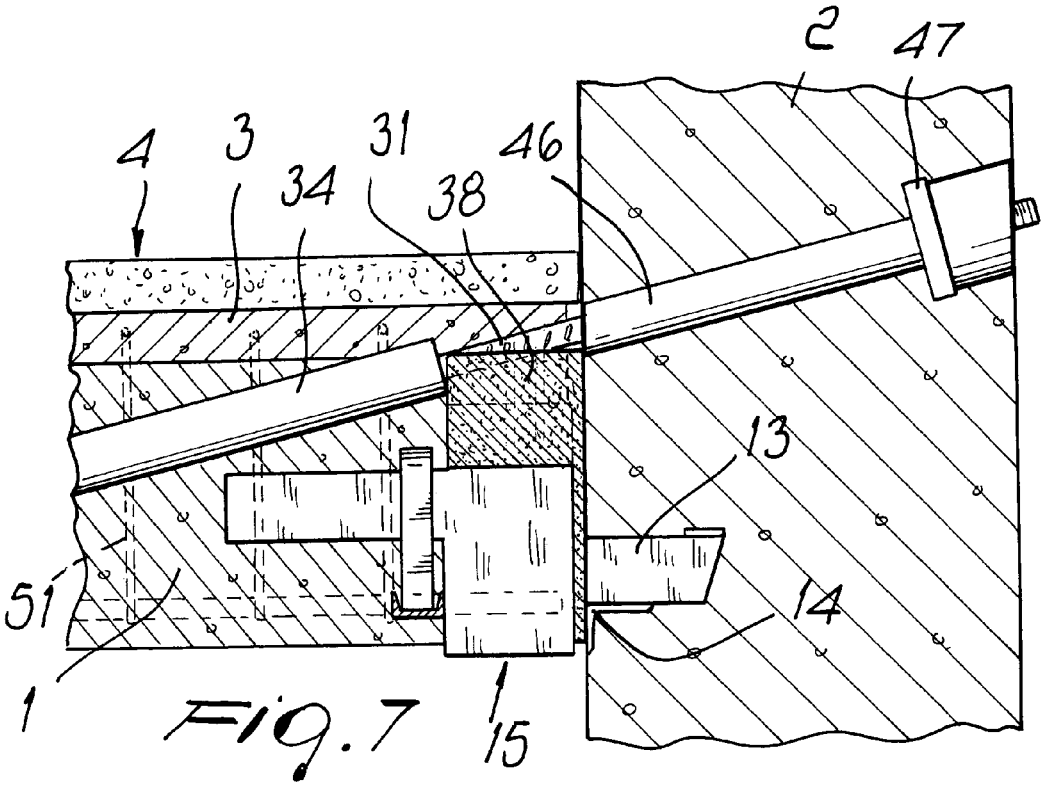
FIG. 7 is a view of the same detail of FIG. 6, with the connection between the beam and the pillar completed by means of an additional cast.
Figure 8:
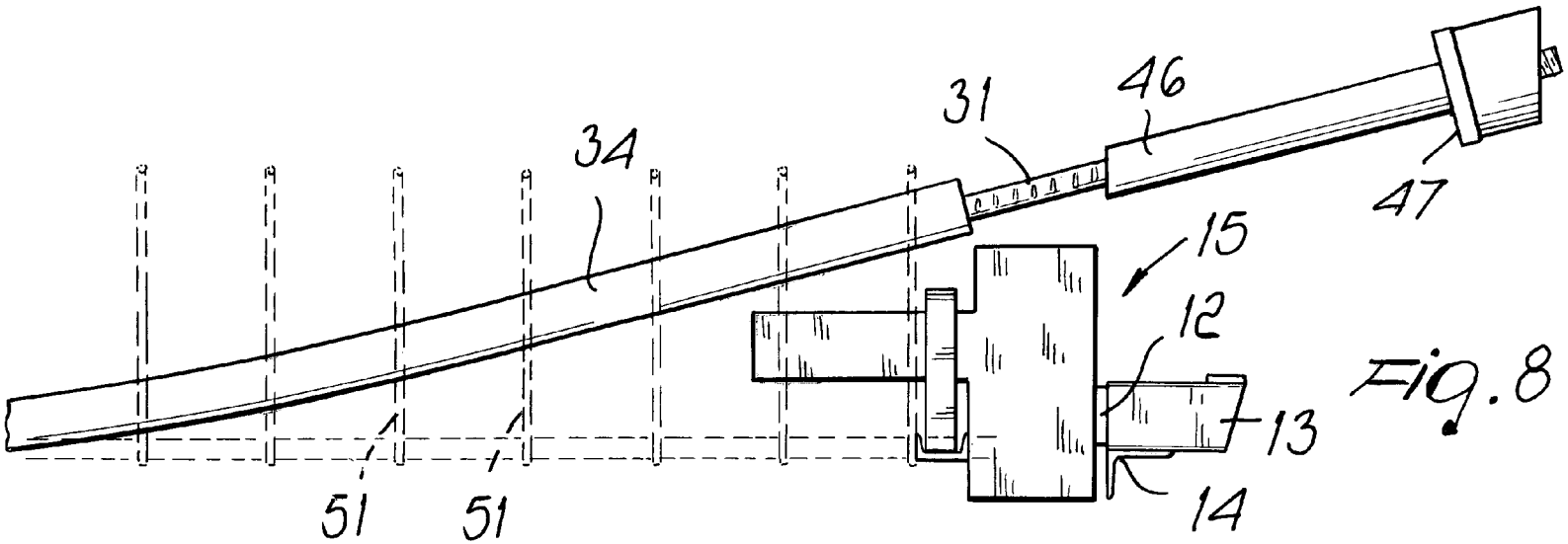
FIG. 8 is a side elevation view of the parts of the device according to the invention, in the first embodiment, to be embedded in a longitudinal end of the beam and in a pillar.
Figure 9:
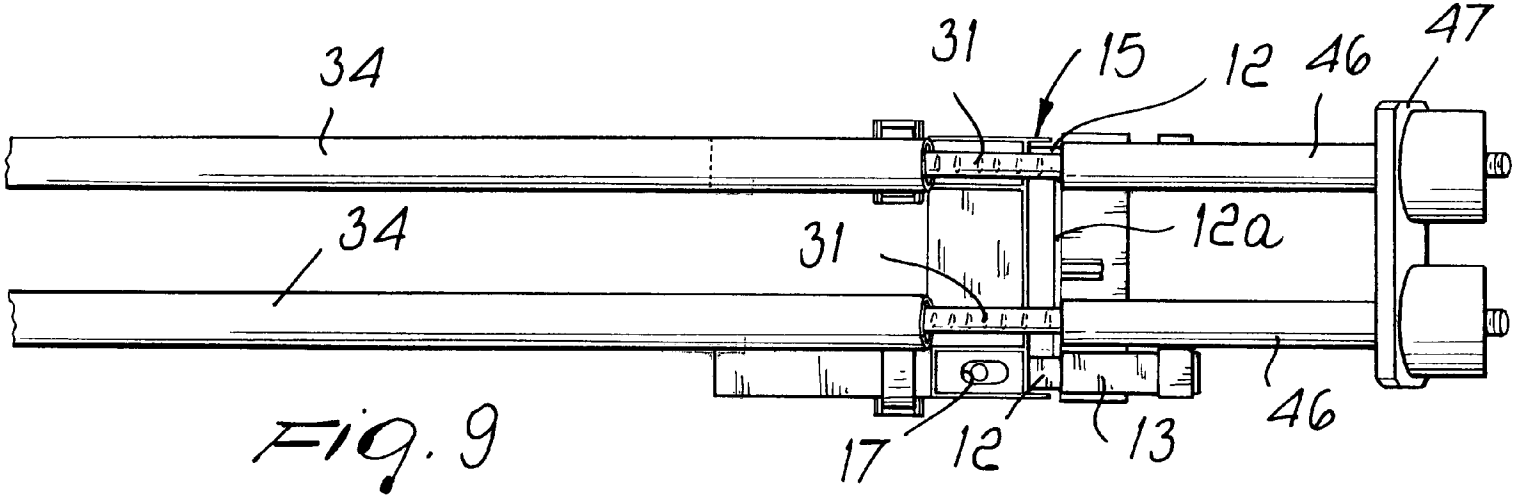
FIG. 9 is a top plan view of the parts of the device shown in FIG. 8.
Figure 10:
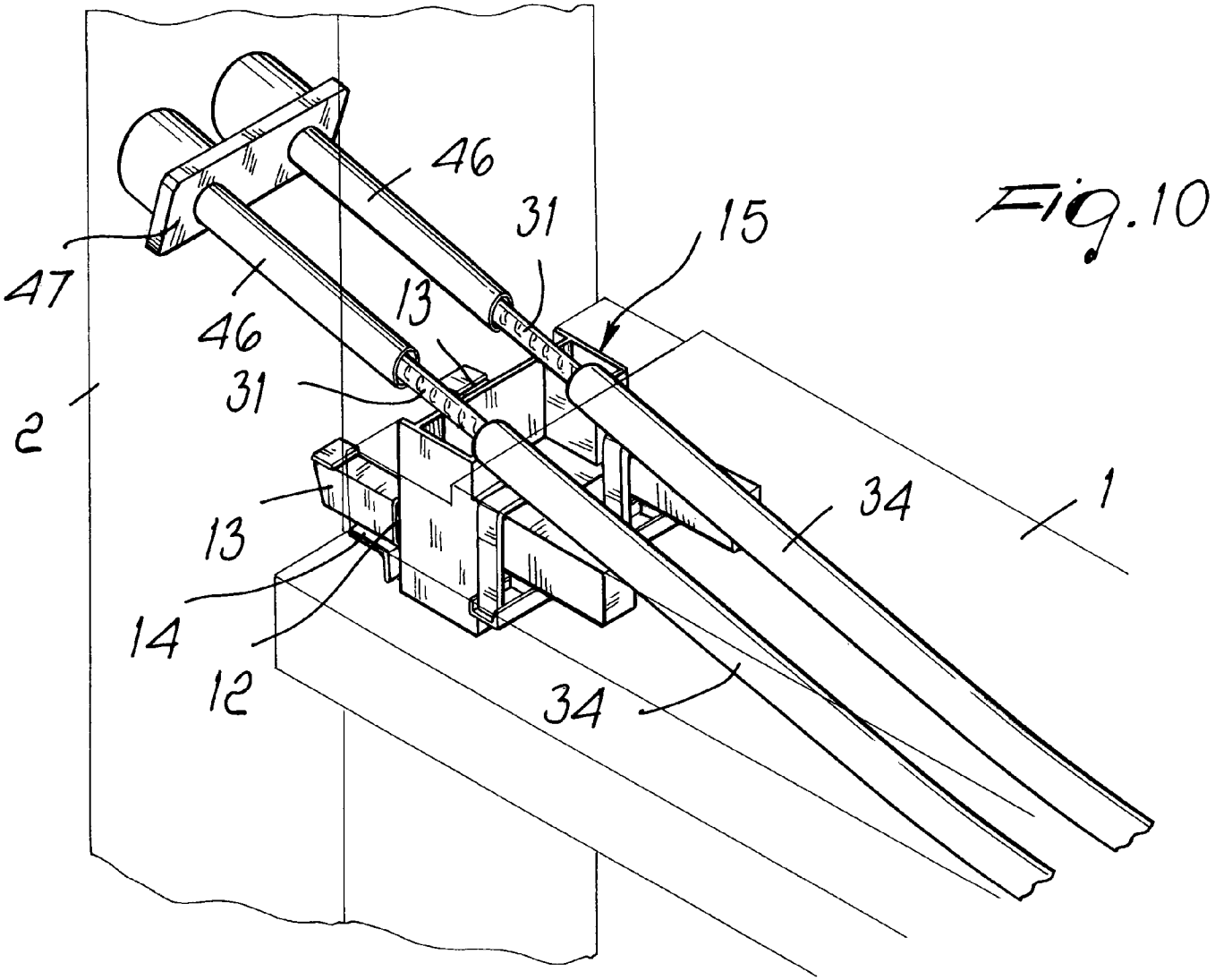
FIG. 10 is a perspective view of the same parts of the device shown in FIGS. 8 and 9, with the beam and the pillar shown in phantom lines.

The first connection means 10, in addition to the substantially horizontal support formed by the brackets 12 and by the corresponding recesses 16 of the box-like structure 15 provided on the lower side of the beam 1 at its longitudinal ends, can be completed by an additional cast 38 between each longitudinal end 1*a* of the beam 1 and the corresponding pillar 2, so as to eliminate the play between the beam and the pillar, as shown in FIG. 7.

Figure 5:
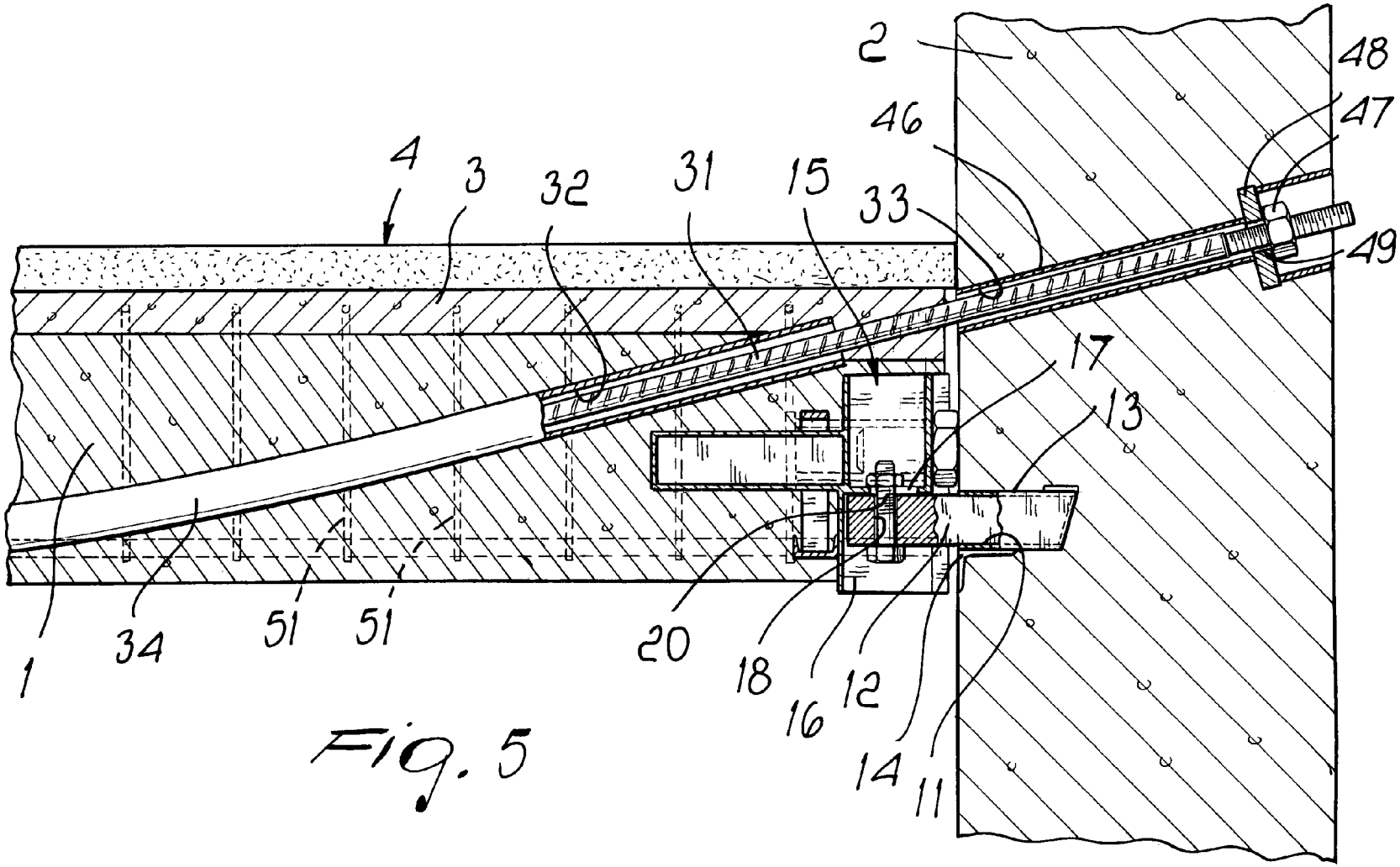
FIG. 5 is a sectional view, taken along a vertical plane, of the connection between a beam and a pillar provided by means of the device according to the invention.
Figure 6:
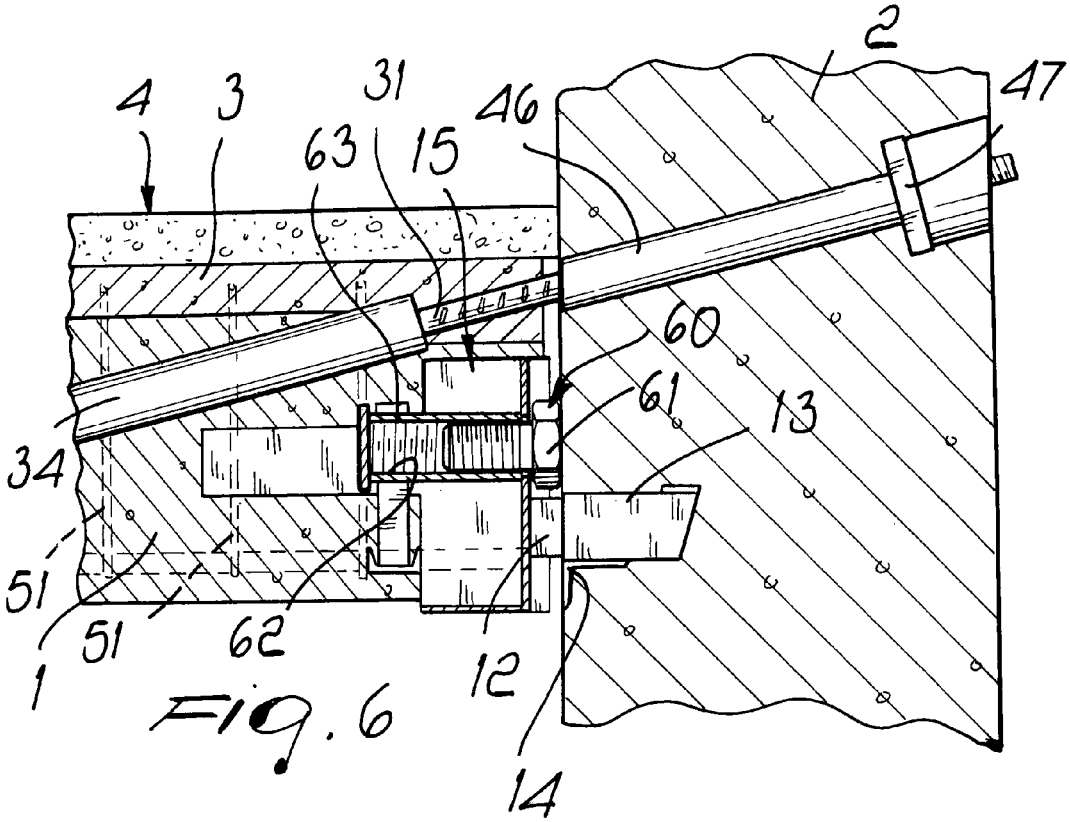
FIG. 6 is an enlarged-scale sectional view of a detail of FIG. 5, taken along a different sectional plane.

As an alternative, such plays can be eliminated by means of an adjustable supporting element 60, which is connected to each one of the longitudinal ends 1*a* of the beam 1, as shown in FIGS. 5 and 6.

More particularly, the adjustable support 60 can be constituted by a screw element 61 that mates with a threaded seat 62 that is formed correspondingly in a bush 63 that is embedded in the body of the beam 1 proximate to each one of its longitudinal ends. The bush 63 can be optionally connected to the box-like structure 15 by welding.

The seat 62 is open on the side of the beam 1 that is designed to be directed toward the pillar 2 so as to receive the screw element 61, which as a consequence of its screwing or unscrewing in the seat 62, can protrude by the desired extent from the longitudinal end 1*a* of the beam 1 so as to rest against the side of the pillar 2 that is directed toward said beam 1. Substantially, by screwing or unscrewing the screw element 61 after resting the beam on the brackets 12 it is possible to eliminate the play between the ends 1*a* of the beam 1 and the pillar 2.

It should be noted that the beam 1 can also be constituted by a pre-stressed beam.

The assembly of the device according to the invention is as follows.

The beam 1 is rested on the brackets 12 that protrude from the two pillars 2 that must support the beam 1 and is fixed to them by bolting, as described, providing two couplings at least of the hinge type and preferably of the interlocking type between the ends 1*a* of the beam 1 and the pillars 2. The play between the ends 1*a* of the beam 1 and the pillars 2 is then eliminated by means of an additional cast 38 or by unscrewing the screw element 61. The tension elements 31 are then inserted through the corresponding tubular bodies 46 and 34 and the nuts 47 are tightened. The tightening of the nuts 47 on the tension elements 31 tensions the tension elements 31, pre-loading the beam 1 upward, achieving an effect that is similar to pre-stressing, and therefore giving the beam 1 higher resistance to the loads that it will be required to support. In this manner it is possible to provide beams 1 which, with an equal load strength with respect to beams that are simply rested on the pillars 2, can be significantly lower, with a uniform distribution of the stresses on the beam 1 thanks to the fact that the tension elements 31 pass through the entire beam 1.

If the auxiliary tension elements 31*a* are provided, they too are inserted and tensioned, in a manner similar to what has been described with reference to the tension elements 31.

The device according to the invention therefore maintains the same advantages as the device disclosed in U.S. Ser. No. 09/669,970, further achieving more uniform distribution of stresses inside the beam 1.

In practice it has been found that the device according to the invention fully achieves the intended aim, since by allowing to reduce the height of the beam it allows to use prefabricated concrete components also in sectors in which up to now the prefabrication method has been applied to a minimal extent, further achieving uniform distribution of the stresses inside the entire beam and activating an innovative static layout.

Another advantage of the device according to the invention is that it achieves high earthquake safety even during construction.

The device thus conceived is susceptible of numerous modifications and variations, all of which are within the scope of the appended claims; all the details may further be replaced with other technically equivalent elements.

In the examples of embodiment cited above, individual characteristics, given in relation to specific examples, may actually be interchanged with other different characteristics that exist in other examples of embodiments.

Moreover, it is noted that anything found to be already known during the patenting process is understood not to be claimed and to be deleted, from the claims.

In practice, the materials used, as well as the dimensions, may be any according to requirements and to the state of the art.

The disclosures in Italian Patent Application No. MI2002A002119 from which this application claims priority are incorporated herein by reference.

What is claimed is:

1. A device for connecting a beam to pillars or similar supporting structural elements in order to erect buildings, by means of prefabricated concrete components, comprising first means for connecting two end regions of the beam to the pillars and second means for connecting the beam to the pillars, said first connection means being adapted to provide a coupling between each one of the two end regions of the beam and the corresponding pillar, said second connection means comprising at least one tension element that passes through the beam and is connected to the pillars by means of ends thereof that protrude from the beam, said second connection means being independently and separately connectable with respect to said first connection means, wherein said first connection means comprise, for each one of said connection regions, a cavity that is formed in the body of the corresponding pillar, said cavity being formed by a box-like body that is embedded in said pillar.

2. The device according to claim 1, wherein said at least one tension element passes with play through a passage formed in the beam.

3. The device according to claim 2, wherein said passage is formed by at least one tubular body that is embedded in the body of the beam.

4. The device according to claim 3, wherein said tubular body is substantially rigid.

5. The device according to claim 3, wherein said tubular body is flexible.

6. The device according to claim 3, wherein said tension element is constituted by a bar or the like.

7. The device according to claim 3, wherein said tension element is constituted by a cable element.

8. The device according to claim 3, wherein said cavity is open on the side of said pillar that is directed toward the beam, said cavity accommodating a bracket that protrudes from said side of the pillar and is fixed to said beam.

9. The device according to claim 8, wherein said bracket protrudes from said side of the pillar and forms a support for an end region of said beam, said bracket being fixed to said beam with a coupling at least of the hinge type.

10. The device according to claim 8, wherein said cavity and said bracket are inclined upward toward said beam.

11. The device according to claim 8, wherein said bracket is fixed to said beam by bolting.

12. The device according to claim 8, wherein said beam has a lower recess for supporting said bracket at an end thereof that is designed to be directed toward said pillar.

13. The device according to claim 2, wherein said passage is curved or shaped like a broken line in which the concavity is directed upward.

14. The device according to claim 2, wherein multiple tension elements are arranged inside said passage.

15. The device according to claim 2, wherein said passage, starting from the end regions of the beam toward an intermediate region of the longitudinal extension of the beam, gradually approaches the lower side of the beam.

16. The device according to claim 1, wherein said at least one tension element protrudes with ends thereof from the beam proximate to the end regions of the beam.

17. The device according to claim 1, wherein said beam is a beam of the pre-stressed type.

18. The device according to claim 1, wherein said tension element is formed monolithically.

19. The device according to claim 1, wherein said tension element is composed of multiple segments that are connected one another.

20. The device according to claim 19, wherein said segments are partly rigid and partly flexible.

21. The device according to claim 1, wherein said at least one tension element is connected, by means of the end thereof that protrudes from the beam, to the pillars above the connection regions formed by said first connection means.

22. The device according to claim 1, wherein said at least one tension element comprises an auxiliary tension element that passes with play through at least one auxiliary passage that is formed within the beam and is curved or shaped like a broken line in which the concavity is directed downward, said auxiliary tension element being connected, by means of ends thereof that protrude from the beam proximate to the longitudinal ends thereof, to the pillars below the connection regions formed by said first connection means.

23. The device according to claim 22, wherein said auxiliary passage, starting from the end regions of the beam toward an intermediate region of the longitudinal extension of the beam, gradually approaches the upper side of the beam.

24. The device according to claim 22, wherein in said pillar there is a passage for at least one of said tension element and said auxiliary tension element that connects said beam to said pillar.

25. The device according to claim 24, wherein in said pillar said passages for at least one of said tension element and said auxiliary tension element are formed by at least one tubular body that is embedded in said pillar.

26. The device according to claim 25, wherein said box-like body and said tubular body embedded in the body of the pillar are rigidly connected to each other.

27. The device according to claim 22, further comprising means for tensioning at least one of said at least one tension element and said at least one auxiliary tension element.

28. The device according to claim 22, wherein at least one of said at least one tension element and said at least one auxiliary tension element has ends constituted by threaded portions that engage respective nuts that abut against the corresponding pillar and can be tightened in order to tension at least one of said element and said auxiliary tension element.

29. The device according to claim 22, wherein the tubular body or the auxiliary tubular body embedded in said beam for the passage of at least one of said tension element and of said auxiliary tension element is connected to the reinforcement frame of the beam.

30. The device according to claim 1, wherein said first connection means comprise, for each end region of the beam, two regions for connecting the beam to the corresponding pillar, said two connection regions being spaced one another horizontally transversely to the longitudinal extension of the beam.

* * * * *